United States Patent [19]

Sharma

[11] 4,406,267

[45] Sep. 27, 1983

[54] ELECTROMAGNETICALLY CONTROLLED FUEL INJECTION PUMP SPILL PORT VALVE ASSEMBLY

[75] Inventor: Rameshwar P. Sharma, Dearborn, Mich.

[73] Assignee: Ford Motor Company, Dearborn, Mich.

[21] Appl. No.: 298,570

[22] Filed: Sep. 2, 1981

[51] Int. Cl.[3] ..... F02M 59/00

[52] U.S. Cl. ..... 123/458; 123/459; 417/505; 251/129

[58] Field of Search ..... 417/279, 505; 123/458, 123/459, 506, 449, 451; 251/634, 129, 322

[56] References Cited

U.S. PATENT DOCUMENTS

| | | | |
|---|---|---|---|
| 1,957,435 | 5/1934 | Baur | 123/139 |
| 3,724,436 | 4/1973 | Nagata | 123/139 E |
| 3,727,881 | 4/1973 | Ward | 251/129 |
| 3,762,379 | 10/1973 | Hobo | 123/32 AF |
| 3,779,225 | 12/1973 | Watson et al. | 123/139 E |
| 3,880,131 | 4/1975 | Twaddell et al. | 123/139 E |
| 3,896,779 | 7/1975 | Omori et al. | 123/139 E |
| 4,059,369 | 11/1977 | Eheim | 417/494 |
| 4,073,275 | 2/1978 | Hofer et al. | 123/458 |
| 4,083,346 | 4/1978 | Eheim | 417/505 X |
| 4,379,442 | 4/1983 | Simko | 123/458 |

FOREIGN PATENT DOCUMENTS

| | | | |
|---|---|---|---|
| 1035170 | 7/1958 | Fed. Rep. of Germany | 417/299 |

*Primary Examiner*—Richard E. Gluck
*Attorney, Agent, or Firm*—Robert E. McCollum; Clifford L. Sadler

[57] ABSTRACT

A spill port control valve assembly for a fuel injection pump of the radial plunger type having a plunger barrel and a fuel inlet-spill port in the wall of the barrel, the port being controlled by a tiltable valve that is self-aligning and actuated by a solenoid to a closed position to permit pressurization of the fuel.

1 Claim, 1 Drawing Figure

ELECTROMAGNETICALLY CONTROLLED FUEL INJECTION PUMP SPILL PORT VALVE ASSEMBLY

Figure 1:
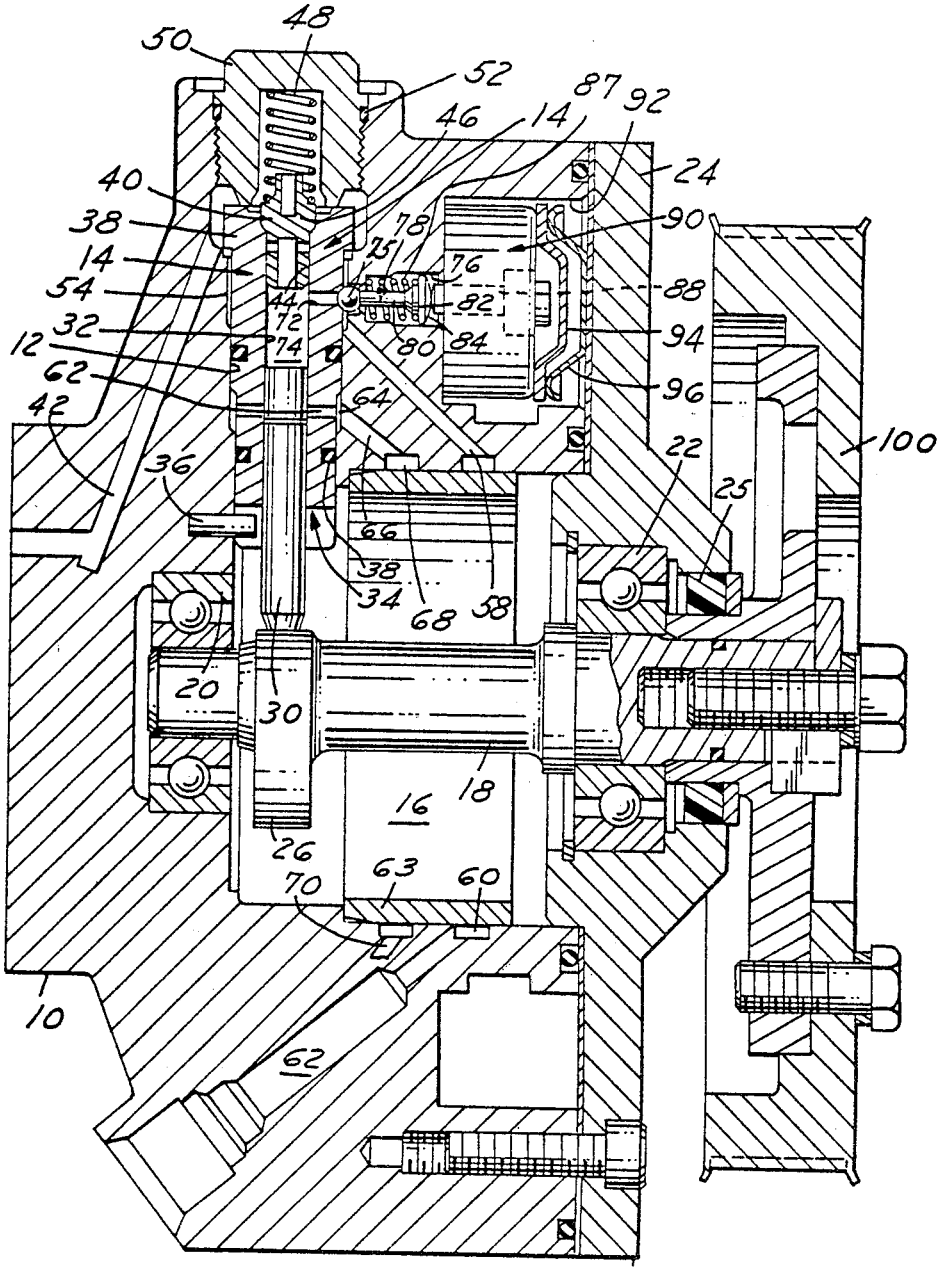

This invention relates in general to a fuel injection pump for an internal combustion engine of the spark ignition type. More particularly, it relates to the construction of a spill port control valve and its actuator for such a pump, and one that is compact, lightweight, economical to construct, and relative simply in design.

The fuel pump of the invention is of the radial plunger, spill port type with an excess of fuel always delivered to the pumping chamber. Injection is consummated by controllably blocking a spill port to permit a buildup of pressure sufficient to open a conventional retraction type delivery valve and inject fuel through a fuel injection nozzle into the engine combustion chamber.

The previous use of mechanical components for spill type fuel injection pumps usually required the additionl elements of a metering sleeve with a helix thereon, and injection timing controls, such as speed advance and cold start retard mechanisms and other control devices, to provide the desired fuel delivery characteristics to match the air flow characteristics of the engine. The use of an electromagnetically controlled fuel pump eliminates the need for such matching and, therefore, eliminates the need for the above additional elements.

The present invention relates to an electromagnetically controlled spill port valve assembly for a pump of the radial plunger type. The pump in this case utilizes a cam on a short engine driven camshaft, the cam being provided with acceleration and deceleration ramps to provide the desired characteristics to the pumping cycle. The pump plunger barrel assembly houses the pumping plunger at one end, incorporates a fuel delivery valve at the opposite end without the necessity of a separate housing, and also provides a machined spill valve seat in the wall of the barrel at a location between the plunger and delivery valve. The spill port is controlled by a valve that is universally seatable and self-aligning. It is actuated by an electromagnetic means, in this case a solenoid.

The use of electromagnetic means to control fuel injection pumps of the spill port type is not new per se. For example, U.S. Pat. No. 3,779,225, Watson et al, shows a radial plunger type pump having an electromagnetically controlled spill port. However, the spill port control valve is not of the self-aligning type.

U.S. Pat. No. 3,880,131, Twaddel et al, is another example of a radial plunger type pump with an electromagnetic means for controlling a spill port. However, the electromagnetically operated valve again is not of the self-aligning type for cooperation with a spill port in the barrel of the housing.

Other examples of electromagnetically controlled valves in cooperation with fuel injection pumps are shown and described in Hobo et al, U.S. Pat. Nos. 3,762,379, Omorie et al, U.S. 3,896,779, Nagata et al, U.S. 3,724,436, and Eheim, U.S. 4,059,369. Hobo et al, shows merely and on/off electromagnetically controlled valve to control the inlet supply of fuel to a pumping plunger. The pump per se is not of the spill port type. Omorie shows merely and on/off type electromagnetically controlled valve controlling the inlet supply of fuel to the pump as a function of a particular electrical signal from the engine. Magata et al merely shows an electromagnetically controlled valve used in a fuel injection pump. It is not of the spill port type. Eheim merely shows an on/off electromagnetically controlled valve controlling the inlet supply of fuel as a function of whether the engine is on or off. The fuel flow is controlled by a helix on a metering sleeve.

U.S. Pat. No. 1,957,435, Baur, shows in FIG. 4 the axial alignment of both the plunger and a delivery valve in the barrel of the pump. This pump, however, utilizes a helix type metering valve formed on the end of the plunger for control of the fuel flow and shows none of the advantages of this invention in the use of an electromagnetically operated spill port control valve.

It is therefore, a primary object of the invention to provide a compact fuel injection pump of the spill port type with a valve seat in the wall of the barrel that cooperates with a self-aligning spill port control valve operated selectively by an engine controlled electromagnetic means to selectively provide engine operation at the desired time as a function of various changing engine parameters.

Other objects, features and advantages of the invention will become more apparent upon reference to the succeeding detailed description thereof, and to the drawings illustrating the preferred embodiment thereof; wherein the figure is a cross-sectional view of a fuel injection pump constructed according to the invention.

The figure illustrates the construction of a fuel injection pump embodying the invention. It is essentially a two-piece assembly consisting of a one-piece aluminum housing 10 having at least one radial bore 12 within which is mounted a plunger barrel assembly 14.

The housing 10 has a central cavity 16 within which is received a short engine driven camshaft 18 that is rotatably mounted at opposite ends on a pair of ball bearing units 20 and 22. Housing 10 supports bearing unit 20, while bearing unit 22 is supported within an annular cover plate 24 bolted to and closing the open side of housing 10. A suitable oil seal 25 is provided.

Camshaft 18, in this case, is formed with a single cam 26 that is eccentrically mounted for reciprocation of a pumping plunger 30 engageable therewith. The bottom of the plunger is flat and the plunger rides directly on the cam. While not shown, the cam profile would consist of an acceleration ramp, a constant velocity portion (Archimedes spiral) and a deceleration ramp.

Plunger 30 is slideably mounted in one end of a constant diameter bore 32 of a hardened steel plunger barrel 34. The latter is fixedly mounted longitudinally within the housing bore 32 and keyed to housing 10 by an anti-rotation pin 36. The fuel outlets to the engine fuel injectors are arranged at the other or upper end of bore 32.

The upper end 38 of plunger barrel bore 32 also is formed as a housing for a fuel delivery valve 40 to seat thereagainst to block the flow of fuel to a fuel injection line 42. The delivery valve is of the retraction type having a smaller flow cutoff land 44 at its lower end of a diameter that mates with the diameter of plunger bore 32, and a second larger diameter volume retraction land 46 at its upper end that can extend into the upper end of the plunger barrel for a short distance, as shown. A spring 48 biases the delivery or retraction valve onto its seat in the barrel. The preload of spring 48 is controlled by a nut 50 that is threadably adjustable into the upper end of housing 10 and provided with an annular seal 52 to prevent leakage of fuel out the housing.

The retraction valve operates in a known manner moving upwardly under the increased pressure of the fuel as pumping plunger 30 moves upwardly through a pumping stroke. When the pumping plunger 30 moves downwardly during the intake stroke, the pressure of the fuel in injection line 42 will decrease to a point where the spring 48 will be able to move the retraction valve 40 downwardly into the bore 32. The first effect is for the end of land 44 to engage the bore and shut off the communication of fuel between bore 32 and the fuel injection line 42. The second effect upon continued movement of the valve is to decrease the residual pressure in the fuel injection line 42 by the mass of the retraction valve moving downwardly into the upper part of the plunger bore, which increases the effecting volume in the spring chamber.

Housing 10 is formed with a fuel annulus 54 around the upper end of the stationary plunger barrel 34. This annulus is connected to a source of low pressure fuel through a feed passage 58 intersecting an annular fuel passage 60 in turn connected to a fuel inlet supply line 62. A sleeve 63 seals the passages from leakage into cavity 16. A low pressure supply pump, not shown, would be included in the system to maintain the fuel in inlet 62 at a low pressure. Fuel leaking past plunger 30 is vented through plunger barrel bores 62, an annulus 64, a line 66 connected to a second annulus 68, and a drain or vent line 70.

The pressurization of fuel by plunger 30 is controlled by an inlet-spill port type construction. That is, a through port 72 connects the fuel feed or supply line 58 to the fuel chamber 74 defined in bore 32 between the upper end of plunger 30 and the lower end of delivery 44. So long as spill port 72 remains open, upward movement of plunger 30 will merely move the fuel in chamber 74 out through the spill port 72 and back into the feed line 58. When the spill port 72 is closed, the upward movement of plunger 30 can then pressurize the fuel sufficient to open the delivery valve 40 for flow of fuel to and through the injection line 42.

The spill port 72 in FIG. 1 is controlled by an electromagnetically controlled ball valve 75. The radially outer edge of spill port 72 is formed as a seat for the ball valve 75, which is universally seatable. Housing 10 is provided with a multi-diameter recess 76 in which is slideably and tiltably mounted a valve actuator 78. The latter consists of a stem portion 80 fixedly attached to, i.e., integral with the ball valve and formed with a mushroom shaped head portion 82. The latter has a spherical surface 84 that constitutes a radius of curvature from the center of the ball 75. Thus, slight misalignment of the longitudinal center line of the actuator 78 with respect to the spill port centerline will still cause the forces to act through the center line of the spill port when the ball is seated. This is important as a self-aligning feature to prevent side forces on the ball valve, and to eliminate an alignment problem during installation of the vertically installed plunger barrel and the horizontally mounted ball valve actuator. That is, because of manufacturing tolerances, etc., since the plunger barrel is installed vertically, it is very difficult to exactly align the center line of the actuator 78 at right angles to the ball valve seat constituted by the spill port 72. The construction just described permits a slight cocking of the actuator 78 without inducing side forces.

The actuator in this case is biased by a spring 87 against the movable armature 88 of a solenoid 90 mounted in a recess 92 in housing 10. The solenoid is located in place by an annular retainer 94 and a biasing spring member 96. Since any point on surface 84 is a point on a radius from the centerline of the spill port when the ball valve is seated, and slight misalignment of the centerline of the solenoid armature 88 with respect to the centerline of the spill port 72 will merely result in a tangential point contact between some point on the end of the armature and the spherical surface 84 so that forces still are transmitted along the radius and side forces are eliminated. Therefore, the force exerted by the armature will always act through the center of the ball on the spill hole.

Completing the construction, camshaft 18 in this case is adapted to be driven by an internal combustion engine, through a pulley 100 secured to the camshaft. A gear could be substituted for the pulley, if desired. While only one cam and one plunger barrel assembly is indicated, it will be clear that any multiple of the same could be incorporated into the design without departing from the scope of the invention. The pump design lends itself well for 4, 6 and 8 plunger arrangements because identical pumping and camshaft elements can be used while only the housing changes.

In overall operation, the engine driven camshaft 18 will rotate and force plunger 30 upwardly through a pumping stroke. At the same time, an engine control, not shown, such as a microprocessor unit, for example, will cause energization of solenoid 90 causing a leftward axial movement of armature 88 and a similar movement of plunger 78 and ball valve 75. This movement, which is about .0030 inches, for example, will seat the ball valve in spill port 72 against the force of spring 87.

Assuming chamber 74 previously has been filled with fuel through line 58, the now upward movement of the plunger 30 will pressurized this fuel to a level moving the retraction or delivery valve 40 upwardly against the force of spring 48. Injection line 42 then will fill.

The injection line is adapted to be connected to a conventional fuel injection of the pressure relief type that opens above a predetermined fuel pressure to inject fuel into the engine proper. In this case, therefore, pressurization of fuel chamber 74 to a level sufficient to open the fuel injector will effect passage of fuel out through passage 42.

When the engine control decides that the volume of fuel injected is sufficient for the particular load demand or other condition required, solenoid 90 will then be deenergized. This will immediately permit the pressure of fuel in chamber 74 acting against the ball valve 74 and the force of spring 87 to move the ball valve rightwardly as seen in the figure away from the spill port seat. This will cause a decay of pressure in chamber 74 by passage of fuel into the feed line 58. Accordingly, the pressure of fuel in line 42 will decay until a level is reached at which the force of spring 48 is sufficient to overcome the pressure of fuel on the delivery valve 40. This will allow the lower end of the valve to enter into the upper end of the plunger barrel bore 32 to shut off communication between the injection line 42 and the supply chamber 74. The continued decay of fuel pressure in chamber 74 will continue to permit the retraction valve 40 to enter more of the plunger bore, thus retracting a portion of the valve out of the chamber in which the spring 48 is housed and in effect increasing the volume of the chamber and thereby decreasing the residual pressure of the fuel in line 42. This will prevent after injection or dribbling, in a known manner.

The above cycle is repeated when the pump plunger again moves on its pumping stroke, if the solenoid is again energized. The duration of injection and the quantity of fuel injected will be determined by the length of time the solenoid 90 is energized to close spill port 72. This will be determined in accordance with design parameters and operating conditions of the engine, in a desired manner.

It will be seen from the above that the invention provides a plunger type fuel injection pump of a simple construction that incorporates a self-aligning spill port control valve that permits slight misalignment of the valve actuator without causing side forces to act on the valve.

While the invention has been shown and described in its preferred embodiment, it will be clear to those skilled in the arts to which it pertains that many changes and modification may be made thereto without departing from the scope of the invention.

I claim:

1. A fuel injection pump of the spill port type having a housing having a central cavity therein receiving a rotatable engine driven camshaft, a stationary pump plunger barrel projecting radially from the camshaft through the housing and having a bore containing a plunger at one end movable therein, and an outlet at the opposite end closed by a spring closed fuel delivery valve openable at a predetermined fuel pressure level, the plunger and valve defining a fuel chamber therebetween, cam means on the camshaft engagable with the plunger to move the plunger axially along its bore through a fuel pumping stroke, the barrel having a fuel inlet-spill port opening through the wall of the barrel into the fuel chamber and constituting a valve seat, a source of supply fuel under a low pressure connected to the inlet-spill port, and an electromagnetically controlled spill port control valve movably mounted with respect to the spill port valve seat in a lateral bore connected to the spill port and selectively openable and closable to control the buildup and duration of pressure in the fuel chamber upon movement of the plunger through its pumping stroke, the spill port valve being self-aligning with respect to the valve seat, the spill port valve including a ball universally seatable on the valve seat, a stem type actuator fixed to the ball for movement together, a solenoid having an armature engagable with the actuator, and spring means biasing the ball and actuator and armature to an inoperative position away from the ball valve seat, the actuator being axially movable in the side bore and tiltable therein and having an enlarged mushroom-like land portion on the end opposite the ball valve constituting guide means engagable with the side bore wall, the enlarged land portion having a spherical surface engagable with the solenoid armature, the spherical surface constituting a radius from the center of the ball valve to permit slight misalignment of the centerlines of the armature and actuator without imposing side forces on the ball valve upon energization of the solenoid.

* * * * *